United States Patent [19]

Laing

[11] Patent Number: 4,793,771

[45] Date of Patent: Dec. 27, 1988

[54] IMPELLER FOR SPHERICAL PUMPS

[76] Inventor: Karsten A. Laing, 1253 La Jolla Rancho Rd., La Jolla, Calif. 92037

[21] Appl. No.: 118,780

[22] Filed: Nov. 9, 1987

[51] Int. Cl.[4] ..... B63H 1/26

[52] U.S. Cl. ..... 415/206; 416/90 R; 416/91; 416/185

[58] Field of Search ..... 416/90 R, 91, 185, 186, 416/188; 417/420, 423 L, 423 P; 415/71, 204, 208

[56] References Cited

U.S. PATENT DOCUMENTS

| | | | |
|---|---|---|---|
| 2,918,017 | 12/1959 | Collins | 416/186 |
| 3,225,422 | 12/1965 | Sebok | 416/186 |
| 4,072,446 | 2/1978 | Walker | 417/420 |
| 4,629,116 | 12/1986 | Laing et al. | 417/420 |

FOREIGN PATENT DOCUMENTS

| | | | |
|---|---|---|---|
| 2610362 | 9/1977 | Fed. Rep. of Germany | 416/186 |
| 88497 | 5/1983 | Japan | 416/186 |
| 350763 | 6/1931 | United Kingdom | 416/186 |
| 468255 | 7/1937 | United Kingdom | 416/186 |

*Primary Examiner*—Robert E. Garrett
*Assistant Examiner*—Therese M. Newholm

[57] ABSTRACT

An impeller forming a unit with the spherical rotor of a sphero-pump consists of a disc with vanes and an inlet member, both made by injection molding from resin. A rotor plate made from a thick gauge sheet metal covers the vanes and is held in position by rivet type protrusions on the inlet member and compensates the weight of the rotor.

2 Claims, 2 Drawing Sheets

IMPELLER FOR SPHERICAL PUMPS

BACKGROUND OF THE INVENTION

In contrast to impellers of pumps with a shaft, impellers of spherical pumps which form a unit with the rotor of the spherical motor have two tasks; the conveyence of the liquid and the compensation of the weight of the rotor, which is always many times higher than that of a normal impeller. These impellers are therefore diecast from metal. Diecast parts require machining to obtain the final configuration and smoothness of the surface. In addition, any diecast product never has the precision necessary for balance. Therefore, metal impellers have to be balanced on balancing machines. Furthermore, most castable metals are much less resistant than resin materials.

SUMMARY OF THE INVENTION

The invention shows a design which makes use of resin and sheet metal. The highly anti-corrosive qualities of stainless steel are available in sheet metal qualities and not as a die cast material. The impeller wheel with vanes is made from resin by injection molding. The shroud which covers the vanes consists of a thick gauge sheet metal disc, made by stamping. The two parts are held together by an inlet member, also molded from resin and having rivet type protrusions, which penetrate through the metal disc and are fixed to the impeller wheel. Centering of the unit is performed by a hole in the metal disc which is fixed on the shaft of the rotor.

DESCRIPTION OF THE DRAWINGS

Figure 1:
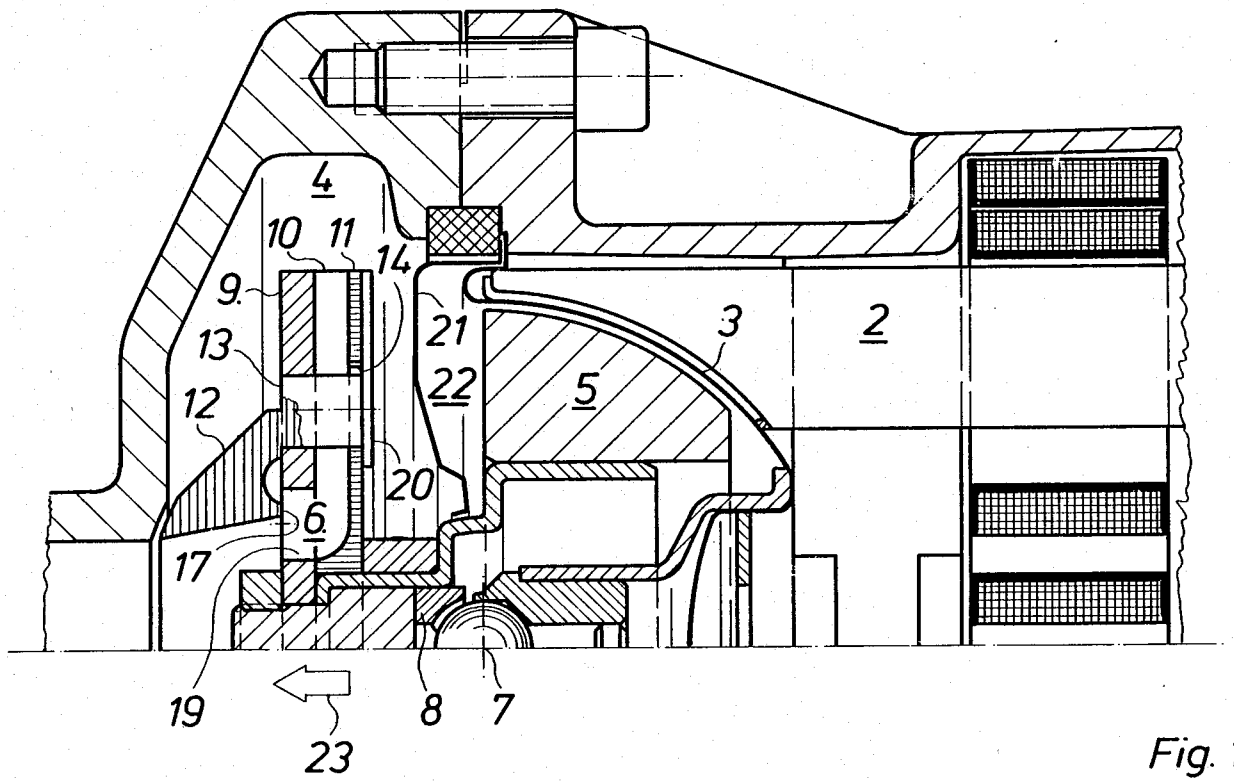
FIG. 1 shows a cross section of a pump with an impeller.
Figure 2:
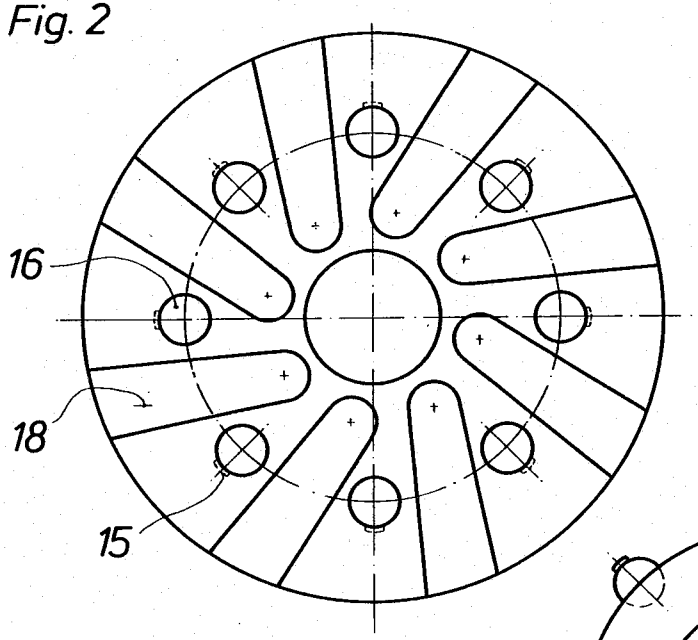
FIG. 2 shows a section of the impeller wheel.

The pump shown in FIG. 1 consists of the stator 2 with windings, the separation wall 3, the pump compartment 4, the armature 5 with a stub shaft bearing cap 8 gliding on the stationary mounted ball 7, and the impeller 6. Said impeller 6 consists of the impeller wheel 11 with vanes 10, the metal disc 9, which is centered on the stub shaft and the inlet member 12 with a number of rivets 13. Each rivet 13 has a nose 14, which snaps into an opening 15 in FIG. 2. Between said two parts 11 and 12, made of resin, the metal disc 9 is enclosed. The stream of liquid flows through the holes 19 into the channels 18 in FIG. 2, where the liquid is accelerated. If the high pressure is obtained, the rim 17 reduces the inlet openings 19, increasing the ratio outer diameter divided by inner diameter. If high volume rates are attained, said inner rim 17 must be large enough to open the holes 19 fully.

Figure 3:
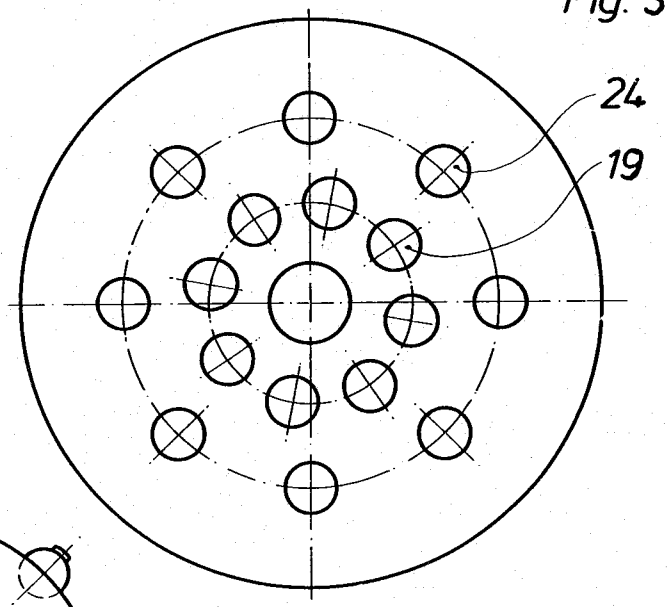
FIG. 3 shows a section of the metal disc.

FIG. 3 shows a section of the sheet metal disc, which in addition to the inlet holes also has holes 24 for the rivets 13.

Figure 4:
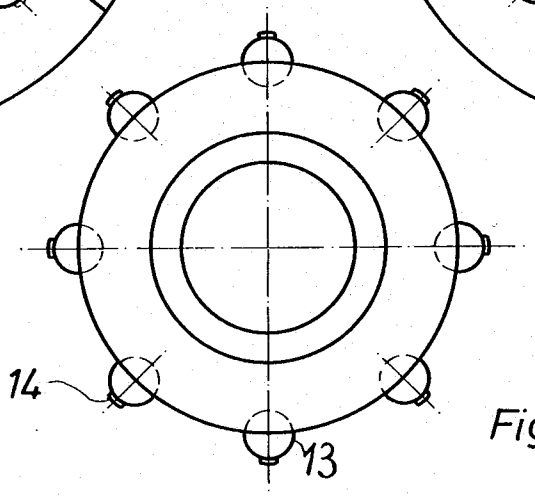
FIG. 4 shows a section of the entrance member.

FIG. 4 shows a section of the entrance member 12 with the rivets 13 with snap noses 14.

I claim:

1. Impeller with vanes and a shroud with a spherical eye portion for single stage centrifugal pumps which forms a rotatably mounted unit with a spherical armature of an electric motor, said unit being pivotably supported by a bearing consisting of a ball and a bearing cap permitting swivel movement, the weight of said impeller compensating the weight of said armature, characterized in that the impeller consists of an impeller wheel (11) with vanes (10), a disc (9) stamped out of sheet metal, said disc being centered on the armature (3) by a central hole and acting as a shroud forming radially extending channels (18) together with the impeller wheel (11) and the vanes (10), the weight of said disc (9) compensating the weight of the rotor (5), said disc (9) having a first circle of holes (19) as ports for the liquid conveyed through the channels (18), a second outer circle of holes (24), and an inlet member (12) forming the spherical eye of the impeller, said inlet member (12) forming a unit with a number of protrusions (13) equally distributed over its circumference, penetrating said holes 924) and congruently arranged holes (16) in the impeller wheel (11), said protrusions (13) having noses (14) which are driven into recesses (15) of the impeller (11) by snap action.

2. Impeller for single stage centrifugal pumps according to claim 1 (new) characterized in that the impeller wheel (11) and the inlet member consist of an organic material.

* * * * *